United States Patent [19]

Shelton

[11] 4,346,916

[45] Aug. 31, 1982

[54] MULTIPLE PLY BUSINESS FORM AND MANIFOLD ASSEMBLY

[75] Inventor: Oscar A. Shelton, Denton, Tex.

[73] Assignee: Moore Business Forms, Inc., Grand Island, N.Y.

[21] Appl. No.: 151,165

[22] Filed: May 19, 1980

[51] Int. Cl.[3] ..... B41L 1/20; B65D 27/10

[52] U.S. Cl. ..... 282/11.5 A; 229/69

[58] Field of Search ..... 282/11.5 A, 12 A, 25; 229/69; 206/610, 611, 620

[56] References Cited

U.S. PATENT DOCUMENTS

| | | | |
|---|---|---|---|
| 3,211,469 | 10/1965 | Chamberlain | 229/69 |
| 3,841,549 | 10/1974 | Wakeman | 229/69 |
| 3,941,308 | 2/1976 | DiGirolomo | 229/69 |
| 4,010,889 | 3/1977 | Allen et al. | 229/69 |

*Primary Examiner*—Paul A. Bell
*Assistant Examiner*—John S. Brown
*Attorney, Agent, or Firm*—Allegretti, Newitt, Witcoff & McAndrews

[57] ABSTRACT

A multiple ply business form having at least a first ply, a second ply, and a third ply positioned intermediate the first and second plies, a plurality of said forms defining a manifold assembly. The upper and lower edge portions of the first and second plies are secured together, such as by glue, but are completely separate from the third or intermediate ply. The third ply is separate from the first and second plies so as to be readily removable from between the first and second plies. The third ply includes first and second side portions and a central portion which is completely severed or free from the first and second side portions when in the assembled condition. The central portion has upper and lower edges that are spaced inwardly and away from the securing glue for the upper and lower edge portions of the first and second plies. The side portions of the third ply and the lateral edge portions of the first and second plies are secured together, such as by glue. The central portion of the intermediate ply has a pair of lateral edges which are contiguous to the side portions. At least one of the side portions and the adjacent lateral edge of the central portion have cooperating and complementary projecting or cut-out portions defined thereon. The first and second plies, the side portions of the third ply and the cooperating cutout and projecting portions define a structure for retaining the central portion of the third ply in a substantially immobile position relative to the first and second plies, even though the central portion is severed or physically separate from other portions of the business form, the cooperating projecting and cut-out portions specifically defining the essential arrangement for preventing relative up and down movement between the third ply and the first and second plies.

16 Claims, 9 Drawing Figures

MULTIPLE PLY BUSINESS FORM AND MANIFOLD ASSEMBLY

BACKGROUND OF THE INVENTION

Field of the Invention and Description of the Prior Art

This invention relates to improved business forms and manifold assemblies and it particularly relates to multiple ply business forms of the type having a pair of outer plies and a removable inner ply, the business forms being initially interconnected as a manifold assembly.

Correspondence stationery systems or mailer constructions are business form assemblies that have been known in the art for many years. These systems comprise manifold assemblies produced on high speed equipment of a known type and generally include at least a pair of outer plies, with the outer plies commonly forming a mailing envelope. The interior of the mailing envelope is stuffed with one or more plies of selected inserts, such as return envelopes, questionnaires, invoices, promotional material, and the like. In these assemblies, it is common to include either plies of carbon paper or carbonless copy paper. It is quite common to have certain material printed on the outer ply to be selectively imprinted on the internal ply by the carbon paper or carbonless copy paper. In carrying this out, however, it is important for the intermediate ply or plies to remain fixed during imprinting and handling because otherwise the printed characters on the inner plies would become illegible if the intermediate ply moves relative to the outer ply.

In addition to remaining fixed during handling and imprinting, it is important for the intermediate ply to be readily removable from association with the other plies by opening the outer plies in any suitable manner, such as by "bursting" the form.

It is seen, therefore, that there are at least two important considerations required in designing correspondence stationery of the type described herein. A problem created by these two requirements is that each requirement conflicts with the other; that is, one requirement calls for the insert material to be secure within the outer plies so as not to move during manufacture, handling, and imprinting while the other requirement calls for the intermediate ply or plies to be readily separable or removable from association with the outer plies.

Examples of prior art manifold assemblies include those shown in Steidinger U.S. Pat. No. 3,104,799, Steidinger U.S. Pat. No. 3,339,827, Van Malderghem U.S. Pat. No. 3,554,438, Allen U.S. Pat. No. 4,010,889, and Peshke U.S. Pat. No. 4,108,352.

SUMMARY OF THE INVENTION

It is therefore an important object of the present invention to provide an improved multiple ply business form of the type having at least a pair of outer plies having an intermediate ply, the intermediate ply being substantially physically free of or detached from other parts of the form, that is, the central or intermediate ply is not joined to the other portions of the business form by glue, perforation lines, or the like, and yet the intermediate ply is securely held in place between the outer plies.

It is also an object of the present invention to provide an improved business form of the type having at least a pair of outer plies and an intermediate ply which is easily removable from between the outer plies and yet the intermediate ply of the form is securely held in place between the outer plies.

It is yet another object of the present invention to provide an improved multiple ply business form having an intermediate ply section which is totally separate from the other plies of the form and yet is securely held in place therein, the form being capable of being manufactured by using "state of the art" equipment, which may be modified as needed.

It is still another object of the present to provide an improved business form of the type having at least a pair of outer plies enclosing an intermediate ply separate from the outer plies and other portions of the form, the intermediate ply including at least one projection, preferably along one lateral edge thereof, for engaging an adjacent side section for thereby holding the intermediate ply securely in place between the outer plies.

It is a further object of the present invention to provide an improved manifold assembly comprised of a plurality of improved multiply business forms which are readily detachable from each other wherein the intermediate ply of each form making up the manifold assembly is not held in association with the other portions of the form by glue, perforation lines or the like and yet the intermediate ply of each form is securely held in place.

Further purposes and objects of the present invention will appear as the specification proceeds.

The foregoing objects are accomplished by providing a multiple ply business form of the type which has at least a first ply, a second ply, and a third ply which is intermediate the first and second plies, the first and second plies having lateral edge portions and upper and lower edge portions, the upper and lower edge portions being secured together, the third ply being removable from association with the first and second plies, first and second side portions and a central portion defining the third ply, the central portion being severed or completely free from a physical connection with the first and second side portions, the central portions having upper and lower edges which are spaced inwardly from the locations securing the upper and lower edge portions of the first and second plies together, side portions of the central portion being secured to lateral edge portions of the first and second plies, the central portion having lateral edges which are substantially contiguous to the side portions, cooperating and complementary projecting and cut-out portions which are defined on at least one of the side portions and on adjacent lateral edge of the central portion, the first and second plies, the side portions, and the cooperating and complementary projection and cutout defining an arrangement for retaining the central portion in a substantially immobile position relative to the first and second plies, the projecting and cut-out portions defining the essential structure for preventing up and down movement of the third ply relative to the first and second plies.

BRIEF DESCRIPTION OF THE DRAWINGS

Particular embodiments of the present invention are illustrated in the accompanying drawings wherein.

DETAILED DESCRIPTION OF THE PREFERRED EMBODIMENTS

Figure 1:
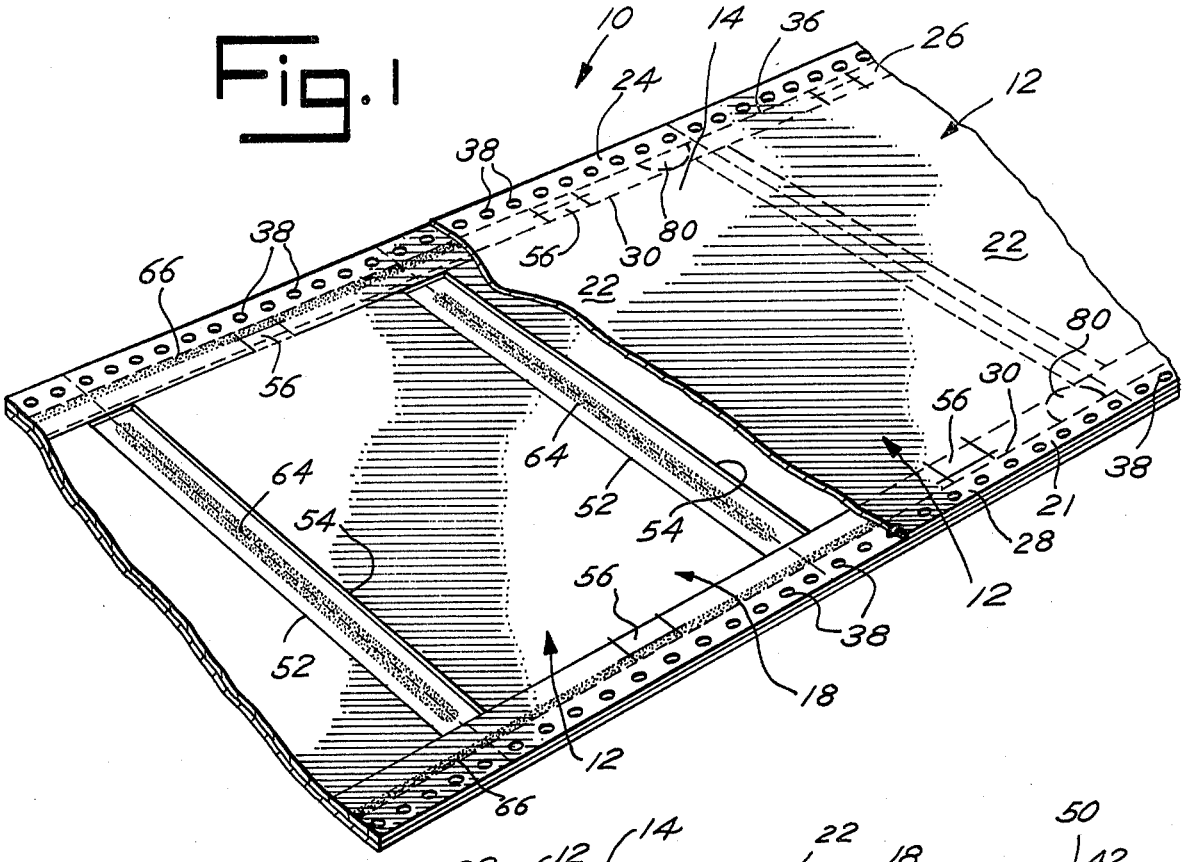
FIG. 1 is pictorial view of one preferred embodiment of my improved manifold assembly having a plurality of intermediate business forms, a portion of the manifold assembly being shown broken away.

Referring to FIG. 1, there is shown a manifold assembly, generally 10, which, in a conventional manner, includes a plurality of contiguous, interconnected individual business forms, generally 12, which, generally, are the subject of the present invention. The manifold assembly 10 and the forms 12 forming the manifold assembly 10 are illustrated in a simple form in the drawings. Although the present invention basically involves a three-ply business form 12 formed as part of the manifold assembly 10, it is to be understood that the present invention may involve more than three plies, with the intermediate ply portion itself being made up of more than one ply, and may also utilize either carbonless copy paper or carbon paper interleaved between the various paper plies. For purposes of simplicity in description, however, the present description of the invention will generally relate to a three-ply business form 12, formed with other such forms into a manifold assembly 10.

Referring to FIGS. 2-5, the business form 12, in simple form, includes a top ply 14, a bottom ply 16, and an intermediate ply 18 located or interleaved between the top and bottom plies 14 and 16. The top and bottom plies 14 and 16 may be formed from any suitable material, such as any conventional paper, plastic or other suitable sheet material commonly used for manufacturing business forms. Both the top ply 14 and the bottom ply 16 are of substantially the same construction. The plies 14 and 16 are each substantially rectangular in shape and are generally elongated from side to side. The intermediate ply may be carbonless copy paper or other suitable sheet material commonly used in the art.

Each ply 14 and 16 includes opposite side portions 20 and 21, and a central portion 22 between or intermediate the side portions 20 and 21. The left side portion 20 of the embodiment illustrated in FIG. 2 includes an outside, upright feed strip 24 and an upright tear strip 26 intermediate the central portion 22 and the outside feed strip 24. The right outside portion 21 includes an outer feed strip 28 similar to the feed strip 24 on the side portion 20. Generally, only one side portion, such as the left side portion, 20 includes a tear strip 26 thereon.

The central portion 22 of both the top ply 14 and the bottom ply 16 includes a pair of lateral edges 30 and top and bottom edges 32 defined along corresponding top and bottom edge portions 34. The lateral edges 30 of the central portion 22, in the assembled condition, as seen best in FIGS. 2-5, is defined by a perforated cut line which enables there to be ease of separation between the tear strip 26 and the central portion 22. Similarly, a perforated cut line 36 is defined between the tear strip 26 and the feed strip 24, in order to facilitate separation of the feed strip 24 from the tear strip 26. Advantageously, the perforated line 36 is so constructed that the feed strip 24 is easier to separate from the tear strip 26 than is the tear strip 26 separated from the central portion 22 of either ply 14 or 16. At the opposite lateral edge 30 of the central portion 22, a perforated line or cut is provided at the edge 30 to separate the feed strip 28 from the central portion 22.

Figure 2:
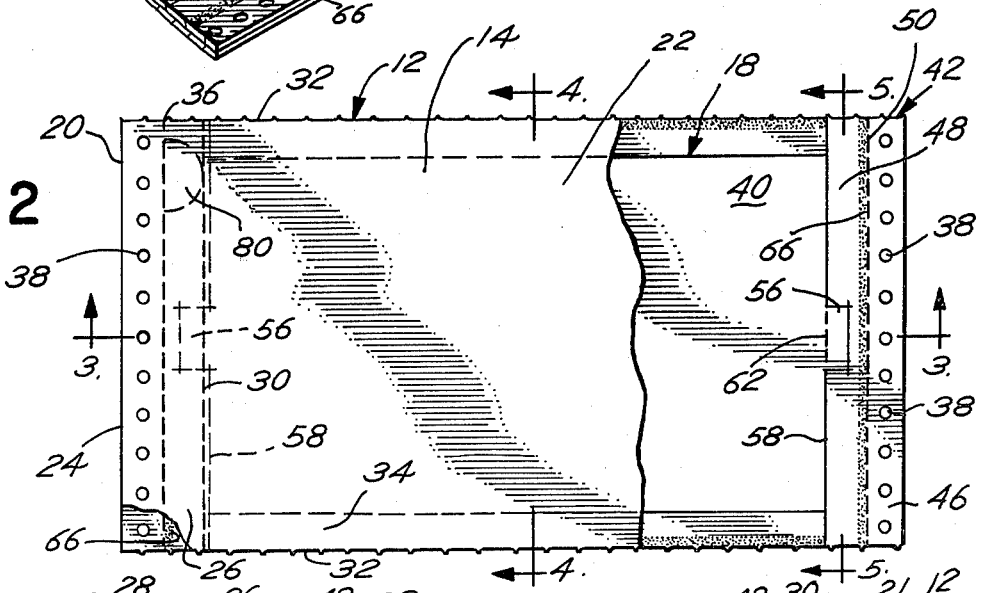
FIG. 2 is a top plan view of a single business form assembly removed from the manifold assembly illustrated in FIG. 1, with one side portion thereof being shown partially broken away.
Figure 3:
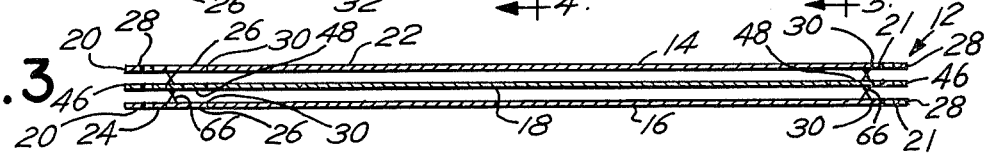
FIG. 3 is an exploded, longitudinal sectional view, taken along the line 3—3 of FIG. 2.

In a conventional manner, each feed strip 24 and 28 has feed holes or apertures 38 aligned longitudinally therealong in order to engage feed pins or drive spindles (not shown) of a conventional business machine (not shown) or the like which handles business forms. As seen in FIGS. 1 and 2, the top and bottom edges 32 also extend along the top and bottom edges of both feed strips 24 and 28, and the tear strip 26, as well as along the central portion 22. Referring to FIG. 1, the perforated or weakened horizontal lines or edges 32 enable each individual business form 12 to be separated from adjacent business forms 12, which together define the manifold assembly 10 shown in FIG. 1.

Figure 6:
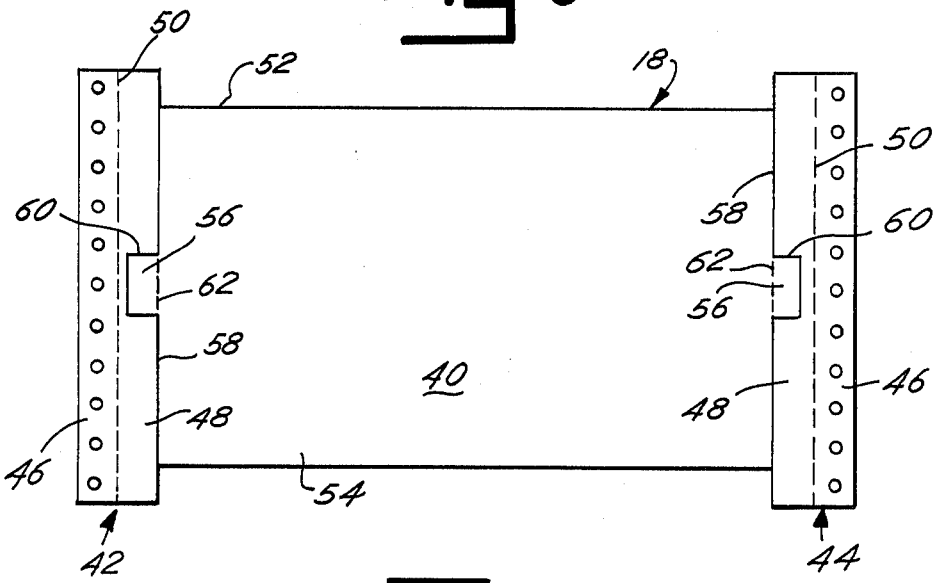
FIG. 6 is a top plan of the intermediate ply utilized in the business form embodiment of FIGS. 1-5.

Referring to FIGS. 2 and 6, the intermediate ply 18 is shown in detail. It is to be understood that one or more intermediate plies 18 may be used and that the single ply 18 shown is representative of one or multiple plies 18. The single ply 18 is shown for purposes of simplicity. The intermediate ply 18 includes a central portion 40, on which indicia (not shown) is generally provided. The central portion 40 generally defines an insert useful in the business form 12 for various purposes, such as for billing or the like. The intermediate ply 18 also includes a left side portion 42 and a right side portion 44, as seen in FIGS. 2 and 6. Both the side portion 42 and the side portion 44 include a feed strip 46 and a tear strip 48. Each feed strip 46 is interconnected to the tear strip 48 along a vertically longitudinal perforated line 50 providing for ease of separation of the feed strip 46 from the tear strip 48.

The central portion 40 of the intermediate ply 18, as best seen in FIGS. 1 and 6, includes die cut upper and lower edges 52 and 54. As seen in FIG. 1, the manifold assembly 10 has the upper edge 52 of one intermediate central portion ply positioned separate and away from the lower edge of the adjacent edge of the central portion thereabove.

With reference to FIG. 6, each central portion 40 further includes at least one laterally directed outward projection 56, advantageously positioned generally centrally of an upright cut line 58 which is defined between the central portion 40 and the inner edge of each tear strip 48. This projection 56 is complementary to and received within a cutout portion 60 provided in the adjacent tear strip 48. The line separating each projection 56, and the edges of the cutout portion 60 is completely severed or cut. Preferably, a perforated line 62 is defined between each projection 56 and the central portion 40 in order that the projection or tab 56 may be readily separated from the central portion 40.

Figure 4:
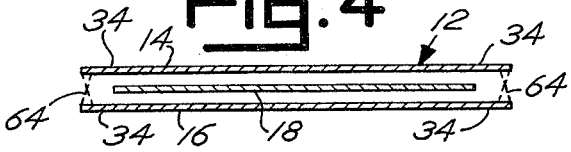
FIG. 4 is a transverse sectional view taken along the line 4—4 of FIG. 2, again showing the assembly in exploded view.
Figure 5:
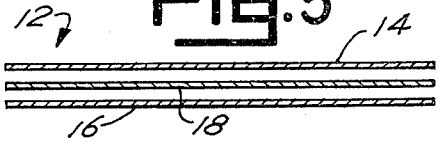
FIG. 5 is a sectional view taken along the line 5—5 of FIG. 2, again in exploded view.

In the manifold assembly 10 and the forms 12, glue lines 64, as seen best in FIGS. 1 and 4 are provided along the top and bottom edge portions 34 of the top and bottom plies 14 and 16 in order that the top and bottom plies 14 and 16 may be secured together along their upper and lower edges 32. The upper and lower edges 52 and 54 of the central portion 40 of the intermediate ply 18 are spaced away from the glue lines 64 in such a way that the glue lines do not act to secure the central portion 40 in place relative to remaining portions of the assembly 10. Again, referring to FIGS. 1 and 3, upright glue lines 66 are positioned between the feed strips 24 and 28 and the tear strip 26, of the top and bottom plies 14 and 16, and the feed strips 46 and 48 of the central portion 40 in order to secure each form 12 together along all three plies, 14, 16 and 18 thereof, when in the assembled condition.

Figure 7:
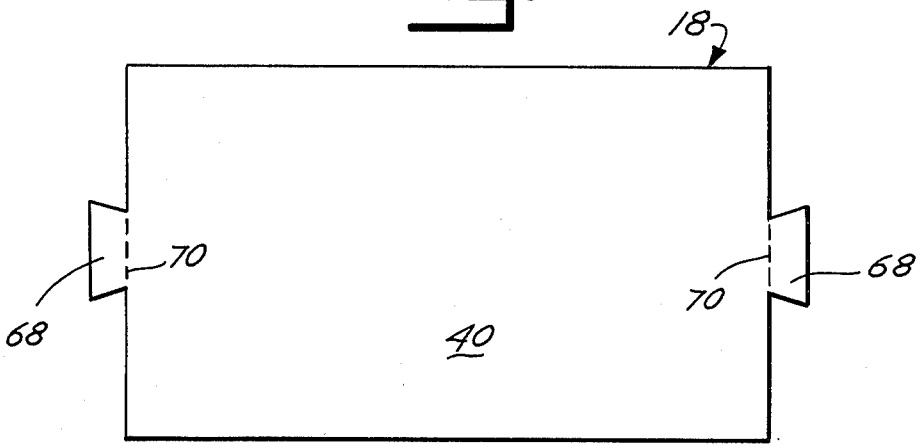
FIG. 7 is one alternate embodiment of the central, useful portion of the intermediate ply of the business form of FIGS. 1-6.
Figure 8:
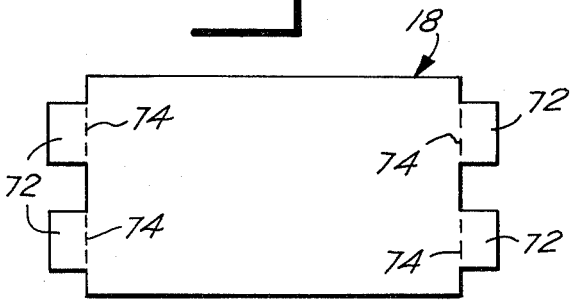
FIG. 8 is another alternate embodiment of the central portion of the intermediate ply of the improved business form.
Figure 9:
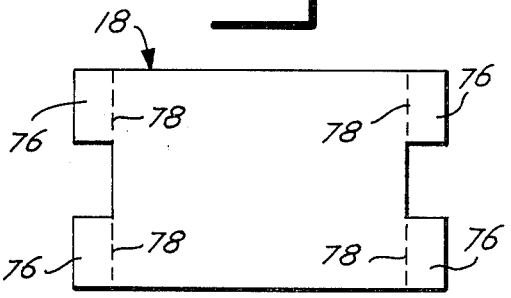
FIG. 9 is a further alternate embodiment of a central portion of an intermediate ply of the improved business form.

Referring to FIGS. 7-9, there are shown alternate embodiments of central portions of intermediate plies 18. In the embodiment of FIG. 7, a projection or tab 68, similar to the projection 56 of the embodiment of FIG. 6, is provided except that the projection 68 is trapezoidal in shape and provides somewhat greater holding strength during the time of handling and imprinting, for example. Also, upon separation of the ply 18, the trapezoidal projections 68 tend to remain in association with the associated strip 48. Again, the projection 68 is desirously separated from the central portion 40 by an upright perforated line 70. In the embodiment of FIG. 8, two projections 72, rather than one projection 56 are provided along the lateral edges of the central portion 40, again providing greater holding strength. The lateral projections 72 are each separated from the central portion 40 by perforated cuts 74. Referring to the embodiment of FIG. 9, the lateral projections 76 are positioned along the upper and lower edges of the central portion 40. Again, the projections 76 are separated from the main portion of the central portion by perforated lines 78.

In the manufacture of the manifold assembly 10 illustrated in FIG. 1, conventional techniques utilized for the manufacture of business forms are used. In a conventional manner, a continuous interconnected series of top and bottom plies 14 and 16 are formed as is the intermediate ply 18. Suitable indicia may be provided thereon before assembling the intermediate ply 18 is formed before assembly. Plies 14, 16, and 18 are brought together after the glue lines 64 and 66 are in place on the forms in the desired location, the glue lines 64 and 66 holding the manifold assembly 10 together. Thereafter, additional desired indicia may be added to the various plies at the desired position. The individual forms 12 are later separated from each other. If desired, before mailing, the feed strips 24, 28, and 46 are removed from the top and bottom plies 14 and 16 and from the intermediate ply 18. Generally, each individual form 12 is mailed or transmitted to a specified individual who opens the form 12 in any conventional manner, such as by "bursting" the business form 12 by grasping the form 12 along its opposite edges and pulling the tear strip 26 away from the rest of the form, while specifically grasping opposite sides of the form 12, generally along the marked thumb areas 80 as seen in FIGS. 1 and 2. When the thumb areas 80 are pulled, the tear strip 26 is removed and the interior central portion 40 defining the useful portion of the form 12 may be readily removed as it is physically separate and apart from the remaining portions of the form. The tabs 56 may then be removed if they have not already been spearated.

During manufacture, imprinting, and handling of the manifold assembly 10 and form 12, the central portion 40 of each form 12 is held securely in place by cooperation of the first and second plies, by the tear strips 48, and by the tabs 56 and cut-out portions 60. In a specific aspect of the securement, cooperation between the tabs or projections 56 along the opposite sides of the central portion 40 and the cooperating and complementary cutout portions 60 defined in the tear strips 48 avoids movement of each central portion 40 in a direction transverse to the upper and lower edges 52 and 54 thereof, the edges 52 and 54 being completely devoid of any holding structure therebetween; the edges 52 and 54 are, specifically, spaced away from the glue lines 64. In addition to preventing such transverse movement, the tabs 56 and cut-out portions also assist in avoiding sidewise movement of the central portion 40, which is in addition to the sidewise holding or confinement provided by the edge to edge contact of the laterally spaced tear strips 48 with the central portion 40. If the projecting tabs 56 remain on the central portion 40 after removal from the top and bottom plies 14 and 16, they are readily separated from the central portion by cutting or tearing along the perforated line 62. It is therefore seen that all of the objects previously set forth have been accomplished by the present invention.

While in the foregoing there has been provided a detailed description of a particular embodiment of the present invention, it is to be understood that all equivalents obvious to those having skill in the art are to be included within the scope of the invention, as claimed.

What I claim and desire to secure by Letters Patent is:

1. In a multiple ply business form of the type having at least a first ply, a second ply, and a third ply intermediate said first and second plies, said first and second plies having lateral edge portions and upper and lower edge portions, means for securing said upper and lower edge portions together, said third ply being removable from between said first and second plies, an improvement in said business form comprising first and second side portions and a central portion defining said third ply, said central portion being severed from said first and second side portions, said central portion having first and second edges spaced away from said securing means, said first and second edges thereby being free of said securing means, further means for securing said side portions of said third ply to said lateral edge portions of said first and second plies, said central portion having third and fourth edges in substantially contiguous relationship to said side portions, and at least one set of cooperating and complementary projecting means and cut-out means defined along said side portions and on said third and fourth edges of said central portion, said projecting means and said cut-out means being completely severed from each other and being directly adjacent each other, said first and second plies, said side portions, and said cooperating and complementary means defining means for retaining said central section in a substantially immobile position relative to said first and second plies, said complementary and cooperating means defining the essential means for avoiding undersired relative movement between said third ply and said first and second plies in a direction transverse to said first and second edges of said central portion.

2. The business form of claim 1 wherein said cooperating means comprises a projection extending along at least one said third and fourth edges, said cut-out means being defined in one or adjacent one of said first and second side portions.

3. The business form of claim 2 wherein a plurality of projections are provided.

4. The business form of claim 1 wherein said cooperating means comprises a substantially rectangular projection extending from each of said third and fourth edges.

5. The business form of claim 1 wherein said cooperating means comprises a trapezoidal projection having a base of reduced size adjacent said third and fourth edges.

6. The business form of claim 1 including more than one intermediate ply.

7. The business form of claim 1 wherein said complementary and cut-out means are provided along both of said side portions and along each of said third and fourth edges.

8. A manifold assembly comprising a plurality of multiple ply business forms separated by transverse lines of weakening, each form having at least a first ply, a second ply and a third ply intermediate said first and second plies, said first and second plies having lateral portions and upper and lower portions, means for securing said upper and lower portions together, said third ply being removable from between said first and second plies, an improvement in each of said business forms comprising first and second side portions and a central portion defining said third ply, said central portion being severed from said first and second side portions, said central portion having first and second edges spaced away from said securing means, said first and second edges thereby being free of said securing means, further means for securing said side portions of said third ply to said lateral edge portions of said first and second plies, said central portion having third and fourth edges in substantially contiguous relationship to said side portions, and at least one set of cooperating and complementary projecting means and cut-out means defined along said side portions and on said third and fourth edges of said central portion, said projecting means and said cut-out means being completely severed from each other and being directly adjacent each other, said first and second plies, said side portions, and said cooperating and complementary means defining means for retaining said central section in a substantially immobile position relative to said first and second plies, said complementary and cooperating means defining the essential means for avoiding undesired relative movement between said third ply and said first and second plies in a direction transverse to said first and second edges of said central portion.

9. A business form of claim 8 wherein said cooperating means comprises a projection extending along at least one said third and fourth edges, said cut-out means being defined in or adjacent one of said first and second side portions.

10. The business form of claim 9 wherein a plurality of projections are provided.

11. The business form of claim 8 wherien said cooperating means comprises a substantially rectangular projection extending from each of said third and fourth edges.

12. The business form of claim 8 wherein said cooperating means comprises a trapezoidal projection having a base of reduced size adjacent said third and fourth edges.

13. The business form of claim 8 including more than one intermediate ply.

14. The business form of claim 8 wherein said complementary and cut-out means are provided along both of said side portions and along each of said third and fourth edges.

15. The business form of claim 1 wherein each projecting means includes a line of weakening adjacent said central portion.

16. The business form of claim 8 wherein each projecting means includes lines of weakening adjacent said central portion.

* * * * *